US010858208B2

(12) United States Patent
Hayashi et al.

(10) Patent No.: US 10,858,208 B2
(45) Date of Patent: Dec. 8, 2020

(54) IMAGE FORMING APPARATUS

(71) Applicant: Brother Kogyo Kabushiki Kaisha, Nagoya (JP)

(72) Inventors: Kakeru Hayashi, Nagoya (JP); Sachie Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 16 days.

(21) Appl. No.: 16/274,609

(22) Filed: Feb. 13, 2019

(65) Prior Publication Data

US 2019/0263611 A1 Aug. 29, 2019

(30) Foreign Application Priority Data

Feb. 26, 2018 (JP) ..... 2018-032082

(51) Int. Cl.
*B65H 5/38* (2006.01)
*B65H 5/36* (2006.01)
(Continued)

(52) U.S. Cl.
CPC ..... *B65H 5/38* (2013.01); *B65H 5/062* (2013.01); *B65H 5/36* (2013.01); *B65H 29/58* (2013.01); *B65H 2402/441* (2013.01); *B65H 2402/443* (2013.01); *B65H 2402/45* (2013.01); *B65H 2404/6111* (2013.01); *B65H 2404/65* (2013.01); *B65H 2404/74* (2013.01); *B65H 2601/521* (2013.01)

(58) Field of Classification Search
CPC . B65H 5/36; B65H 5/38; B65H 29/58; B65H 85/00; B65H 2402/441; B65H 2402/443; B65H 2402/45; B65H 2404/63; B65H 2404/632; B65H 2404/65; B65H 2404/651; B65H 2404/652; B65H 2404/74; B65H 2404/741; B65H 2404/7414; B65H 2404/6111; B65H 2407/20; B65H 2601/521
See application file for complete search history.

(56) References Cited

U.S. PATENT DOCUMENTS

2005/0189712 A1* 9/2005 Carter ..... B65H 29/58 271/303
2009/0039584 A1* 2/2009 Jeong ..... G03G 15/234 270/18
2010/0327510 A1* 12/2010 Matsuno ..... B65H 5/36 271/3.14

FOREIGN PATENT DOCUMENTS

JP 2000-272805 A 10/2000
JP 2008-076976 A 4/2008
JP 2008-297025 A 12/2008

* cited by examiner

*Primary Examiner* — Prasad V Gokhale
(74) *Attorney, Agent, or Firm* — Burr & Brown, PLLC

(57) ABSTRACT

An image forming apparatus includes: a housing; an image forming unit; a conveyor; a curved guide disposed downstream of the conveyor and configured to move between a near position where the curved guide in the housing guides the sheet and a far position farther from the conveyor than the near position; and a guide member extending from the conveyor toward the curved guide and configured to guide the sheet to the curved guide when the curved guide is located at the near position. The guide member has one end portion coupled to the conveyor and the other end portion movable with respect to the curved guide. When the curved guide is moved from the near position to the far position, the other end portion is moved in a direction from a downstream end toward an upstream end of the curved guide.

10 Claims, 9 Drawing Sheets

(51) Int. Cl.
*B65H 5/06* (2006.01)
*B65H 29/58* (2006.01)

IMAGE FORMING APPARATUS

CROSS REFERENCE TO RELATED APPLICATION

The present application claims priority from Japanese Patent Application No. 2018-032082, which was filed on Feb. 26, 2018, the disclosure of which is herein incorporated by reference in its entirety.

BACKGROUND

The following disclosure relates to an image forming apparatus having a conveyance path curved in a sheet conveying direction.

There are conventionally known image forming apparatuses configured to perform face-down discharging in which a sheet is discharged onto an output tray formed on an upper surface of a housing. In one example of such image forming apparatuses, a conveying roller pair constituted by a drive roller and a driven roller is provided for conveying a sheet, and a turning guide partly defining a curved conveyance path is disposed downstream of the conveying roller pair in the sheet conveying direction.

The sheet conveyed by the conveying roller pair is conveyed while being forcibly curved by the turning guide and is discharged onto an output tray formed on an upper surface of the housing.

SUMMARY

A step is in some cases formed at a seam between the conveying roller pair and the turning guide. When the sheet being conveyed is forcibly curved by the turning guide, distortion energy is generated in the sheet. When a trailing end portion of the sheet has passed through the conveying roller pair, the distortion energy generated in the sheet is released by the step formed between the conveying roller pair and the turning guide. In this case, the trailing end portion of the sheet may collide with the turning guide, which may cause collision sound.

Accordingly, an aspect of the disclosure relates to an image forming apparatus capable of reducing collision sound generated when a sheet is conveyed.

In one aspect of the disclosure, an image forming apparatus includes: a housing; an image forming unit disposed in the housing and configured to form an image on a sheet; a conveyor disposed in the housing at a position located downstream of the image forming unit in a sheet conveying direction and configured to convey the sheet along a conveyance path; a curved guide disposed downstream of the conveyor in the sheet conveying direction and configured to move between (i) a near position at which the curved guide is disposed in the housing and guides the sheet conveyed from the conveyor and (ii) a far position that is farther from the conveyor than the near position; and a guide member extending from the conveyor toward the curved guide and configured to guide the sheet conveyed from the conveyor, to the curved guide when the curved guide is located at the near position. The guide member includes: one end portion coupled to the conveyor; and an other end portion movable with respect to the curved guide. The one end portion and the other end portion are opposite end portions of the guide member. When the curved guide is moved from the near position to the far position, the other end portion of the guide member is moved relative to the curved guide in a direction directed from a downstream end of the curved guide in the sheet conveying direction toward an upstream end of the curved guide in the sheet conveying direction.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Hereinafter, there will be described embodiments by reference to the drawings.

Figure 1:
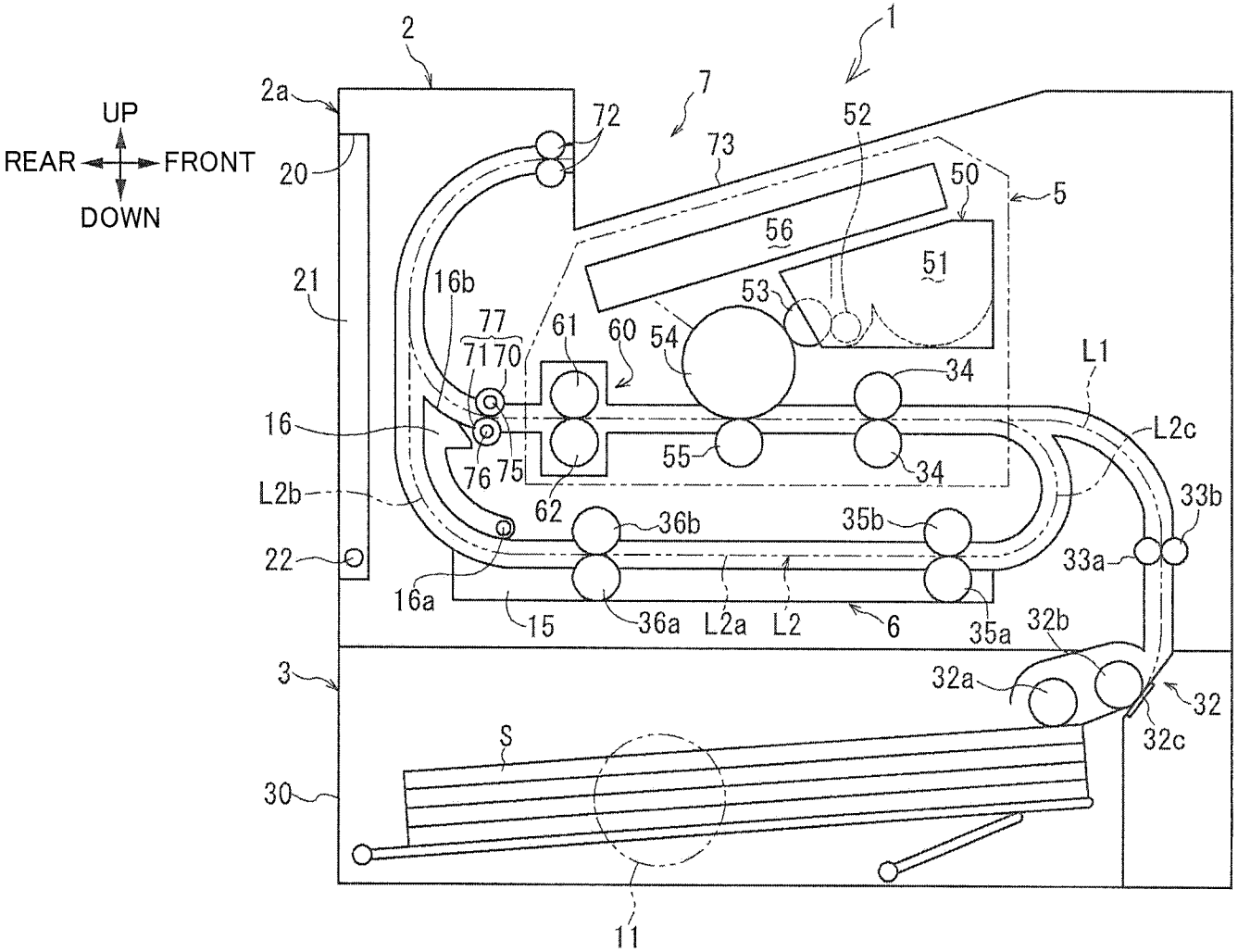
FIG. 1 is a cross-sectional view of an image forming apparatus, taken along its central line.
Figure 2:
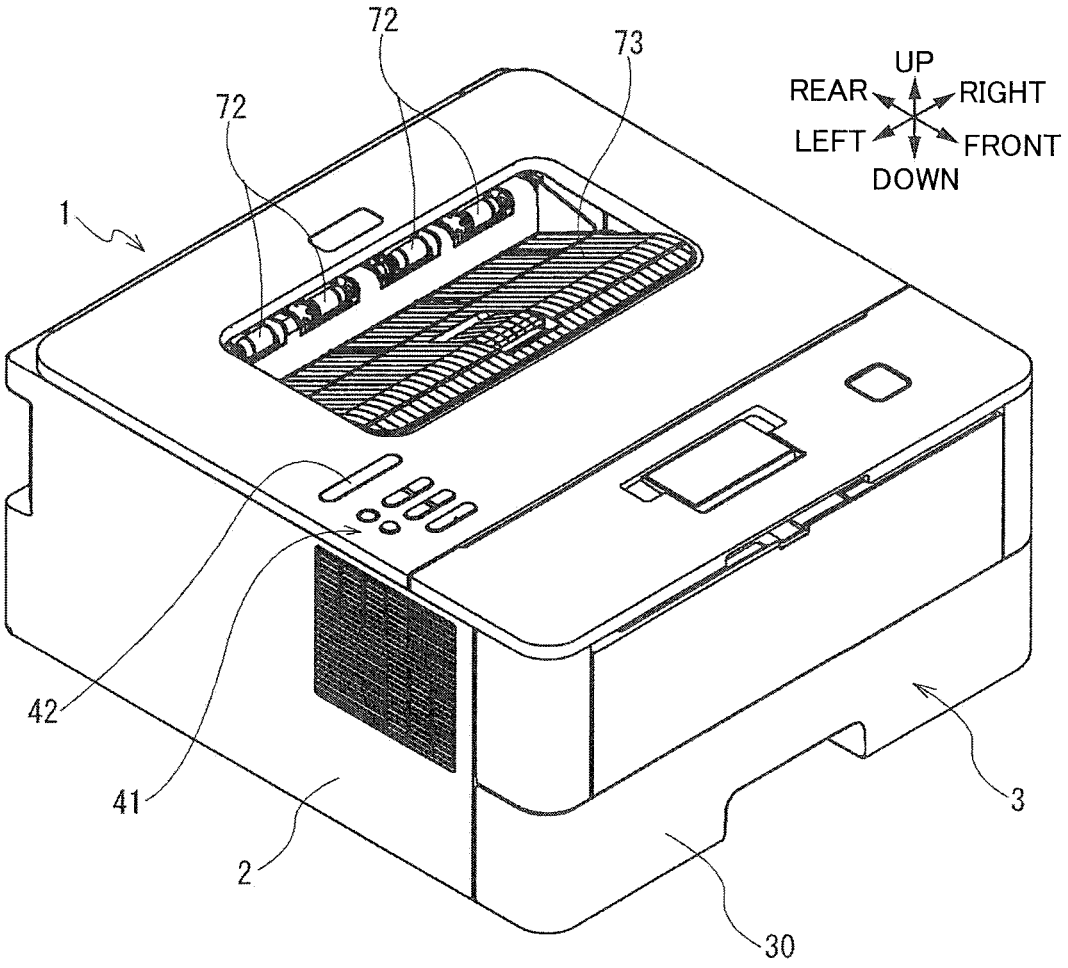
FIG. 2 is a perspective view of an image forming apparatus.
Figure 3:
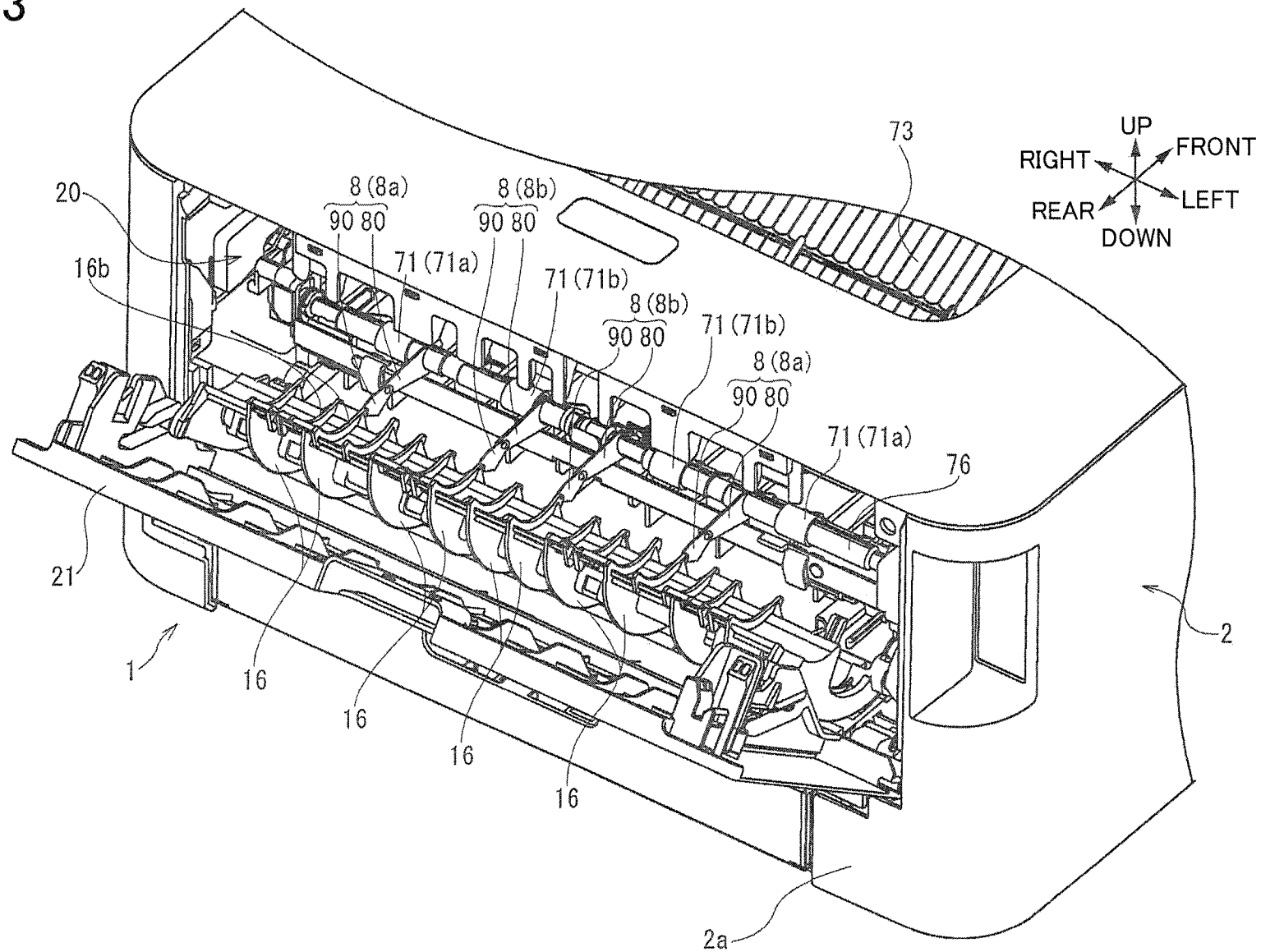
FIG. 3 is a perspective view of a rear portion of the image forming apparatus, with a cover located at an open position.

An image forming apparatus 1 illustrated in FIGS. 1-3 is an image forming apparatus according to one embodiment. The image forming apparatus 1 includes a housing 2, a sheet supplier 3, an image forming unit 5, a re-conveyor 6, a discharger 7, and a motor 11.

In the following description, the right side in FIG. 1 is defined as a front side of the image forming apparatus 1, the left side in FIG. 1 as a rear side of the image forming apparatus 1, the front side of the sheet of FIG. 1 as a left side of the image forming apparatus 1, the back side of the sheet of FIG. 1 as a right side of the image forming apparatus 1, and the upper and lower sides in FIG. 1 respectively as upper and lower sides of the image forming apparatus 1.

The housing 2 houses the sheet supplier 3, the image forming unit 5, the discharger 7, the re-conveyor 6, and the motor 11. An operation interface 41 and a display 42 are provided on an upper surface of the housing 2. The operation interface 41 receives an input operation performed by a user for the image forming apparatus 1. The display 42 displays various kinds of information such as a state and functions of the image forming apparatus 1.

A rear surface 2*a* of the housing 2 has an opening 20. The housing 2 includes a cover 21 for opening and closing the opening 20. A cover shaft 22 extending in the right and left direction is formed at a lower end portion of the cover 21.

The cover 21 is supported by the housing 2 so as to be pivotable about the cover shaft 22. This pivoting movement about the cover shaft 22 enables the cover 21 to move between a closed position (illustrated in FIG. 4) at which the cover 21 closes the opening 20 and an open position (illustrated in FIG. 5) at which the cover 21 exposes the opening 20.

The sheet supplier 3 is disposed at a lower portion of the housing 2 and configured to convey each of sheets S supported by a sheet cassette 30, to the image forming unit 5. The image forming unit 5 is disposed downstream of the sheet supplier 3 in a direction in which the sheet S is conveyed (hereinafter may be referred to as "sheet conveying direction"). The image forming unit 5 forms an image on the sheet S supplied by the sheet supplier 3. The discharger 7 is disposed downstream of the image forming unit 5 in the sheet conveying direction and configured to discharge the sheet S with an image formed by the image forming unit 5, to the outside of the image forming apparatus 1.

The sheet supplier 3 includes: the sheet cassette 30 for supporting the sheet S; a sheet-supply mechanism 32; conveying rollers 30*a*, 33*b*; and a pair of registering rollers 34 configured to convey the sheet S along a conveyance path L1. The image forming apparatus 1 has the conveyance path L1 extending from the sheet supplier 3 to the discharger 7 via the image forming unit 5.

The sheet-supply mechanism 32 includes a sheet-supply roller 32*a*, a separating roller 32*b*, and a separating pad 32*c*. The sheet-supply roller 32*a* supplies the sheets S supported by the sheet cassette 30, toward the separating roller 32*b*. The separating roller 32*b* is disposed downstream of the sheet-supply roller 32*a* in the sheet conveying direction. The separating pad 32*c* is opposed to the separating roller 32*b* and urged toward the separating roller 32*b*.

The sheets S supplied by the sheet-supply roller 32*a* toward the separating roller 32*b* are separated one by one between the separating roller 32*b* and the separating pad 32*c*. The separated sheet S is conveyed toward the conveying rollers 30*a*, 33*b* along the conveyance path L1.

The conveying rollers 30*a*, 33*b* are configured to convey the sheet S and disposed downstream of the sheet-supply mechanism 32 in the sheet conveying direction. The sheet S supplied from the sheet-supply mechanism 32 toward the conveying rollers 30*a*, 33*b* is conveyed by the conveying rollers 30*a*, 33*b* toward the registering rollers 34 along the conveyance path L1.

The registering rollers 34 are disposed downstream of the conveying rollers 30*a*, 33*b* in the sheet conveying direction. The registering rollers 34 temporarily stop movement of a leading edge of the conveyed sheet S to correct a position of the sheet S. The registering rollers 34 then convey the sheet S toward a transfer position of the image forming unit 5 at a predetermined timing.

The image forming unit 5 is disposed in the housing 2 and configured to form an image on the conveyed sheet S. The image forming unit 5 includes: a process cartridge 50 configured to transfer an image onto a surface of the sheet S conveyed from the sheet supplier 3; an exposing unit 56 configured to expose a surface of a photoconductor drum 54 in the process cartridge 50; and a fixing unit 60 configured to fix the image transferred to the sheet S by the process cartridge 50.

The process cartridge 50 is disposed above the sheet supplier 3 in the housing 2. The process cartridge 50 includes a developer containing chamber 51, a supply roller 52, a developing roller 53, the photoconductor drum 54, and a transfer roller 55.

The exposing unit 56 includes a laser diode, a polygon mirror, lenses, and a reflective mirror. The exposing unit 56 exposes the surface of the photoconductor drum 54 by emitting laser light toward the photoconductor drum 54 based on image data input to the image forming apparatus 1.

The developer containing chamber 51 contains toner as a developer. The toner contained in the developer containing chamber 51 is supplied to the supply roller 52 while being agitated by an agitator, not illustrated. The toner supplied from the developer containing chamber 51 is further supplied to the developing roller 53 by the supply roller 52.

The developing roller 53 is disposed in close contact with the supply roller 52 and configured to bear the toner supplied from the supply roller 52 and charged by a slider, not illustrated. Also, a developing bias is applied to the developing roller 53 by a bias applier, not illustrated.

The photoconductor drum 54 is disposed next to the developing roller 53. The surface of the photoconductor drum 54 is charged uniformly by a charging unit, not illustrated, and then exposed by the exposing unit 56. Areas of the photoconductor drum 54 that are exposed to light are lower in electric potential than the other area of the photoconductor drum 54, so that an electrostatic latent image is formed on the photoconductor drum 54 based on the image data. The charged toner is supplied from the developing roller 53 to the surface of the photoconductor drum 54 with the electrostatic latent image formed thereon, whereby the electrostatic latent image is made visible to form a developed image.

The transfer roller 55 is opposed to the photoconductor drum 54, and a negative transfer bias is applied to the transfer roller 55 by the bias applier, not illustrated. At the transfer position, the sheet S is nipped between and conveyed by the photoconductor drum 54 with the developed image formed thereon and the transfer roller 55 with the transfer bias on the surface of the transfer roller 55. As a result, the developed image formed on the surface of the photoconductor drum 54 is transferred to the surface of the sheet S.

The fixing unit 60 includes a heat roller 61 and a pressure roller 62. The heat roller 61 is rotated by a driving force supplied from the motor 11 and is heated by electric power supplied from a power source unit, not illustrated. The pressure roller 62 is opposed to the heat roller 61 and rotated by the heat roller 61 in close contact therewith. When the sheet S on which the developed image is transferred is conveyed to the fixing unit 60 along the conveyance path L1, the sheet S is nipped and conveyed by the heat roller 61 and the pressure roller 62 to fix the developed image to the sheet S.

Intermediate output rollers 77 are disposed in the housing 2 at positions located downstream of the image forming unit 5 in the sheet conveying direction. The intermediate output rollers 77 convey the sheet S conveyed from the fixing unit 60 along the conveyance path L1, toward switch-back rollers 72 along the conveyance path L1. Each of the intermediate output rollers 77 is one example of a conveyor configured to convey the sheet along the conveyance path.

The intermediate output rollers 77 include a first roller 70 and second rollers 71. The first roller 70 is disposed on an upper side of the conveyance path L1, and the second rollers 71 are disposed on a lower side of the conveyance path L1. That is, the second rollers 71 are opposed to the first roller 70, with the conveyance path L1 interposed therebetween. The first roller 70 includes a first rotation shaft 75 and is rotatably supported by the first rotation shaft 75. The second rollers 71 include a second rotation shaft 76 and are rotatably supported by the second rotation shaft 76. The second rotation shaft 76 is one example of a rotation shaft of a second roller.

As illustrated in FIG. 3, the second rollers 71 are arranged along the right and left direction that is orthogonal to the sheet conveying direction. In the present embodiment, the four second rollers 71 are provided.

The four second rollers 71 include two second rollers 71*a* that are rightmost and leftmost rollers among the four second rollers 71. The second rollers 71*a* are arranged respectively at positions corresponding to the widest one of the sheets S conveyable by the image forming apparatus 1. The four second rollers 71 include two second rollers 71*b* that are inner right and left rollers among the four second rollers 71. The second rollers 71*b* are arranged respectively at positions corresponding to the narrowest one of the sheets S conveyable by the image forming apparatus 1. The two second rollers 71*a* are arranged symmetrically in the right and left direction. The two second rollers 71*b* are arranged symmetrically in the right and left direction.

The discharger 7 includes the switch-back rollers 72 and an output tray 73. The switch-back rollers 72 are capable of conveying the sheet S conveyed by the intermediate output rollers 77, to discharge the sheet S to the outside of the housing 2. The output tray 73 is formed on an upper surface of the housing 2 to support the sheet S discharged by the switch-back rollers 72 to the outside of the housing 2.

The switch-back rollers 72 are rotatable in a rotational direction for conveying the sheet S toward the output tray 73. This rotational direction may be hereinafter referred to as "discharging direction". The switch-back rollers 72 are also rotatable in a rotational direction reverse to the discharging direction. This direction may be hereinafter referred to as "re-conveying direction". When the switch-back rollers 72 are rotated in the re-conveying direction, the sheet S conveyed from the fixing unit 60 to the discharger 7 is conveyed toward the image forming unit 5 again.

The image forming apparatus 1 defines a re-conveyance path L2 below the image forming unit 5. The sheet S conveyed by the switch-back rollers 72 rotated in the re-conveying direction is conveyed toward the image forming unit 5 along the re-conveyance path L2 again. The re-conveyance path L2 is a re-conveyance path through which the sheet S with the image formed on one of its opposite surfaces by the image forming unit 5 is conveyed toward the image forming unit 5 again.

The sheet S conveyed to the re-conveyance path L2 is further conveyed toward the image forming unit 5 by a second re-conveying roller 36*a* and a first re-conveying roller 35*a* provided on the re-conveyance path L2. A second driven roller 36*b* is opposed to the second re-conveying roller 36*a*. A first driven roller 35*b* is opposed to the first re-conveying roller 35*a*.

The re-conveyance path L2 branches off from the conveyance path L1 at a branch position located between the intermediate output rollers 77 and the switch-back rollers 72. The re-conveyance path L2 merges with the conveyance path L1 at a merging position located between the conveying rollers 30*a*, 33*b* and the registering rollers 34.

The re-conveyance path L2 includes: a main path L2*a* which is defined below the image forming unit 5 and in which a first re-conveying roller 35 and a second re-conveying roller 36 are disposed; a first curved path L2*b* defined between the branch position and the main path L2*a*; and a second curved path L2*c* defined between the main path L2*a* and the merging position.

A re-conveying chute 15 is provided below the main path L2*a*. The re-conveying chute 15 extends horizontally and defines at least a portion of the re-conveyance path L2 and supports the first re-conveying roller 35 and the second re-conveying roller 36. The image forming apparatus 1 is capable of performing duplex printing in which the sheet S with the image formed on one of its opposite surfaces by the image forming unit 5 is conveyed to the image forming unit 5 again via the re-conveyance path L2 by the re-conveyor 6 having the re-conveyance path L2, and an image is formed on the other surface of the sheet S.

The housing 2 includes curved guide members 16 (each as one example of a curved guide) disposed between the cover 21 and the intermediate output rollers 77 in the front and rear direction. The curved guide members 16 are disposed downstream of the intermediate output rollers 77 in the sheet conveying direction. It is noted that the curved guide members 16 have the same construction, and thus the following description will be provided for one of the curved guide members 16 for simplicity unless otherwise required.

A pivot shaft 16*a* is formed at a lower end portion of the curved guide member 16. The pivot shaft 16 is supported by the housing 2 such that the curved guide member 16 is pivotable about the pivot shaft 16*a*. The curved guide member 16 pivots about the pivot shaft 16*a* so as to move between (i) a near position (illustrated in FIG. 4) at which the curved guide member 16 is located in the housing 2 at a position near the intermediate output rollers 77 and (ii) a far position (illustrated in FIG. 5) farther from the intermediate output rollers 77 than the near position.

The curved guide member 16 defines a portion of the conveyance path L1 and defines a portion of the re-conveyance path L2. The curved guide member 16 has a curved portion 16*b* defining the portion of the conveyance path L1. When the curved guide member 16 is located at the near position, the curved portion 16*b* guides the sheet S conveyed from the intermediate output rollers 77, such that the sheet S is curved.

Figure 4:
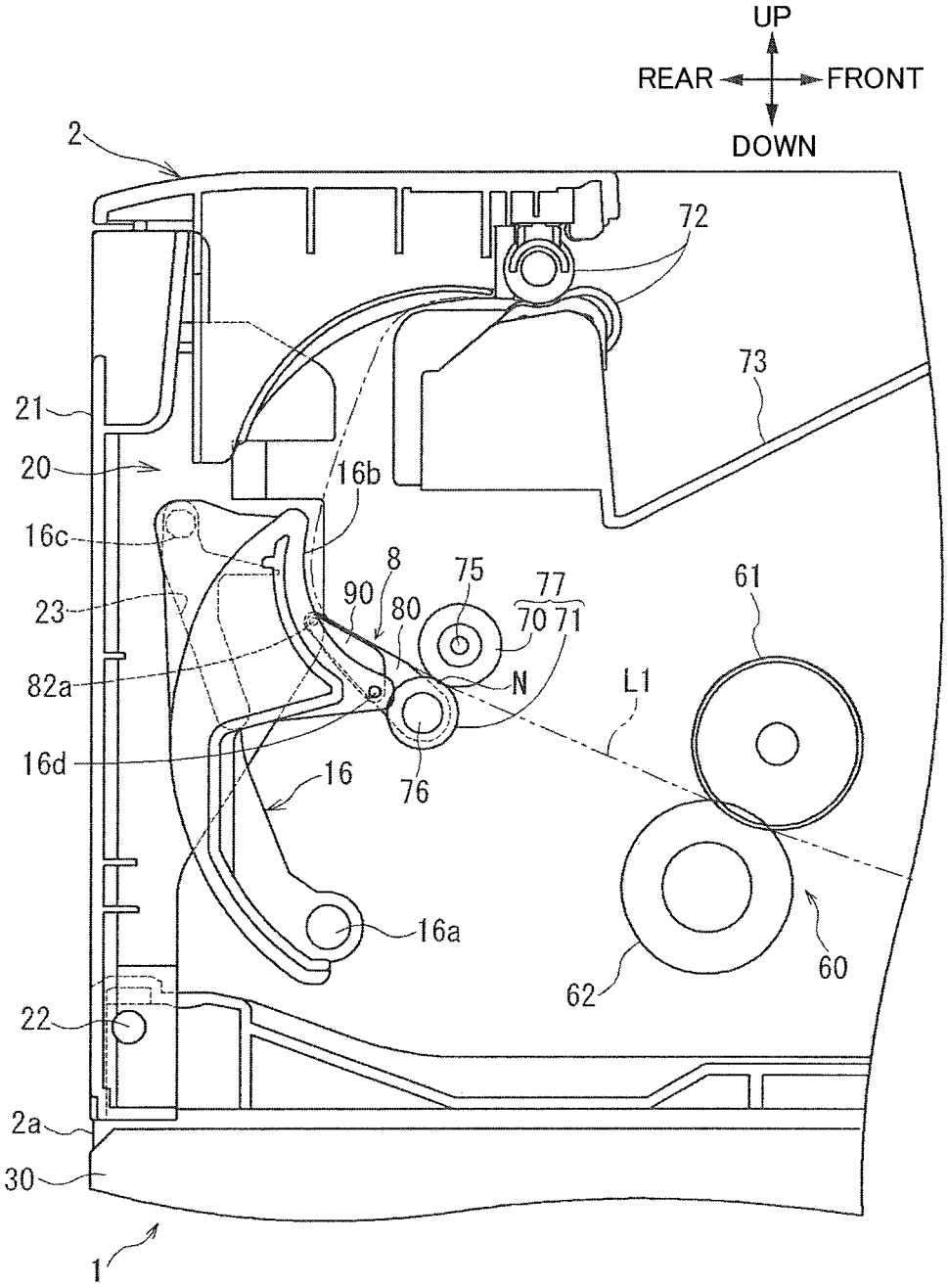
FIG. 4 is a side elevational view in cross section in a state in which the cover is located at a closed position, and a curved guide member is located at a near position.
Figure 5:
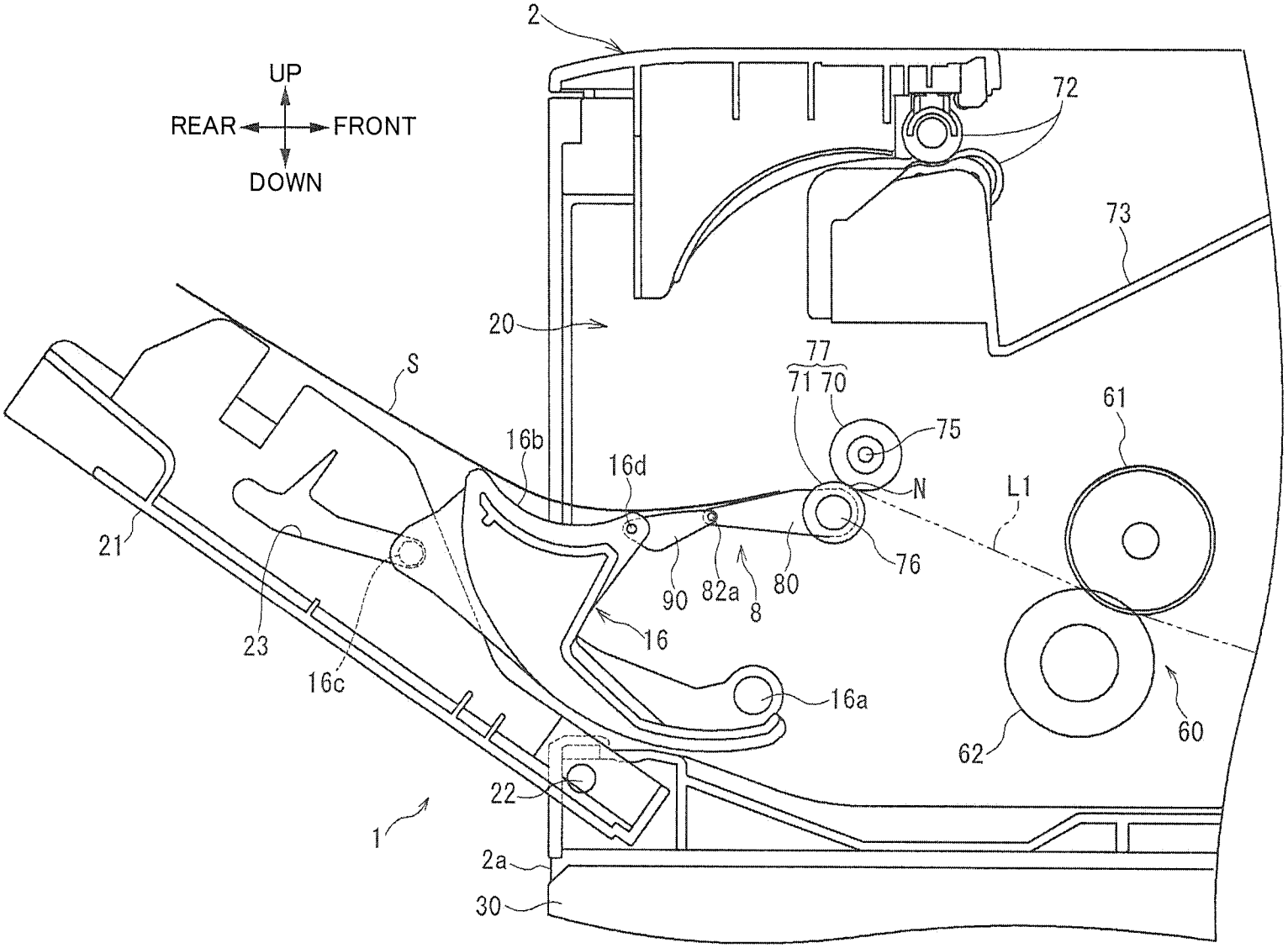
FIG. 5 is a side elevational view in cross section in a state in which the cover is located at the open position, and the curved guide member is located at a far position.

As illustrated in FIGS. 4 and 5, when located at the closed position, the cover 21 stands in a perpendicular direction (see FIG. 4), and when located at the open position, the cover 21 is inclined rearward from the closed position (see FIG. 5).

When located at the near position, the curved guide member 16 stands in the perpendicular direction (see FIG. 4), and when located at the far position, the curved guide member 16 is inclined rearward from the near position (see FIG. 5).

The cover 21 includes a first guide-hole definer 23. The curved guide member 16 includes an engagement protrusion 16*c* engaged with the first guide-hole definer 23. The first guide-hole definer 23 defines an elongated hole that extends substantially in the up and down direction when the cover 21 is located at the closed position. The engagement protrusion 16*c* is slidably engaged with the first guide-hole definer 23.

In a state in which the cover 21 is located at the closed position, and the curved guide member 16 is located at the near position, the engagement protrusion 16*c* is located at an upper end portion of the first guide-hole definer 23. When the cover 21 pivots toward the open position in the state in which the cover 21 is located at the closed position, and the curved guide member 16 is located at the near position, the engagement protrusion 16*c* engaged with the first guide-hole definer 23 is pulled rearward by the cover 21, causing the curved guide member 16 to pivot from the near position toward the far position. In this case, the engagement protrusion 16*c* slides in the first guide-hole definer 23 in a direction directed from an upper end portion toward a lower end portion of the first guide-hole definer 23.

When the cover 21 has reached the open position, the curved guide member 16 is located at the far position. In the state in which the curved guide member 16 is located at the far position, the engagement protrusion 16*c* is located at a lower end portion of the first guide-hole definer 23.

When the cover 21 pivots toward the closed position in the state in which the cover 21 is located at the open position, and the curved guide member 16 is located at the far position, the engagement protrusion 16*c* engaged with the first guide-hole definer 23 is pressed frontward by the cover 21, causing the curved guide member 16 to pivot from the far position toward the near position. In this case, the engagement protrusion 16*c* slides in the first guide-hole definer 23 in a direction directed from the lower end portion toward the upper end portion of the first guide-hole definer 23. When the cover 21 has reached the closed position, the curved guide member 16 is located at the near position.

That is, the curved guide member 16 is moved from the near position toward the far position in conjunction with the movement of the cover 21 from the closed position toward the open position. The curved guide member 16 is moved from the far position toward the near position in conjunction with the movement of the cover 21 from the open position toward the closed position. The distance from the second rollers 71 to the curved portion 16*b* of the curved guide member 16 in the state in which the curved guide member 16 is located at the far position is greater than the distance from the second rollers 71 to the curved portion 16*b* of the curved guide member 16 in the state in which the curved guide member 16 is located at the near position.

As illustrated in FIGS. 4-7, coupling members 8 are provided between the curved guide members 16 and the intermediate output rollers 77. The curved guide members 16 and the intermediate output rollers 77 are coupled to each other by the coupling members 8.

As illustrated in FIG. 3, the coupling members 8 are arranged along the right and left direction. In the present embodiment, the four coupling members 8 are provided. The four coupling members 8 include two coupling members 8*a* that are rightmost and leftmost coupling members among the four coupling members 8. The right coupling member 8*a* is located between the right second roller 71*a* and the right second roller 71*b* in the right and left direction. The left coupling member 8*a* is located between the left second roller 71*a* and the left second roller 71*b* in the right and left direction. The four coupling members 8 include two coupling members 8*b* that are inner right and left coupling members among the four coupling members 8. The coupling members 8*b* are located between the second rollers 71*b* in the right and left direction. Thus, the coupling members 8 are different from the second rollers 71 in position in the right and left direction. It is noted that the coupling members 8 have the same construction, and thus the following description will be provided for one of the coupling members 8 for simplicity unless otherwise required.

Figure 6:
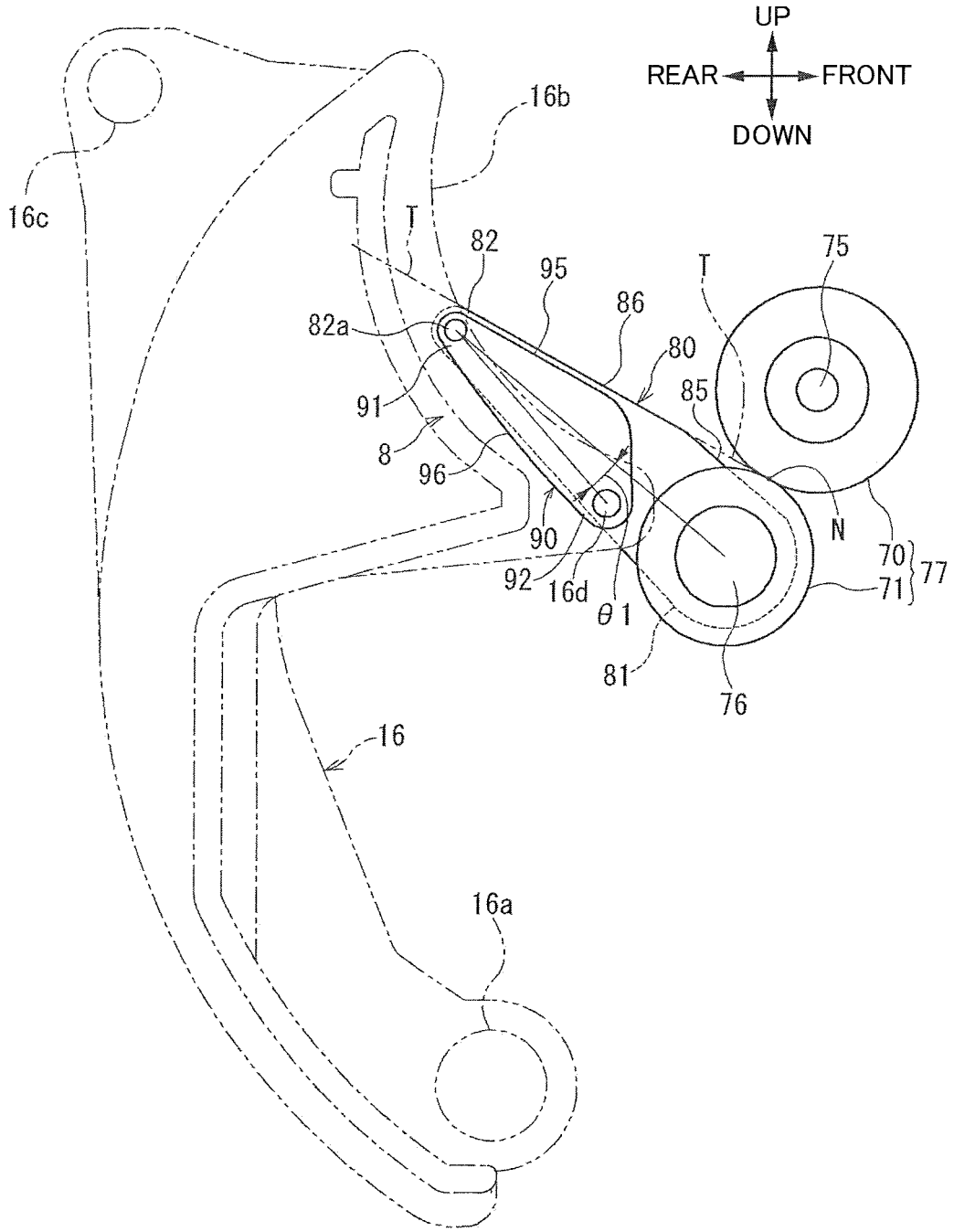
FIG. 6 is an enlarged side elevational view in cross section, illustrating a state in which the curved guide member is located at the near position.
Figure 7:
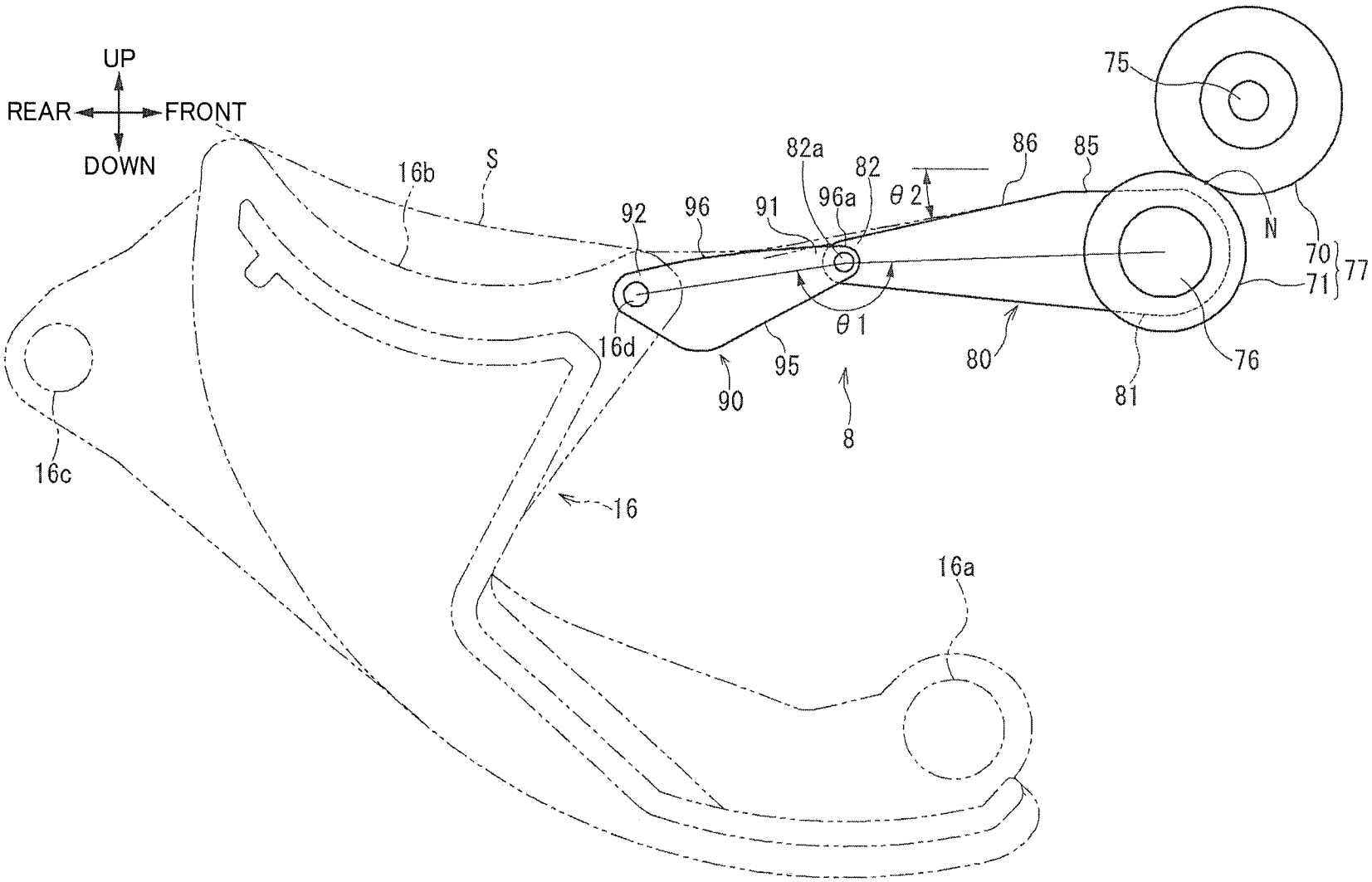
FIG. 7 is an enlarged side elevational view in cross section, illustrating a state in which the curved guide member is located at the far position.

The coupling member 8 includes a guide member 80 (as one example of a guide member) and a linking member 90 (as one example of a linking member). As illustrated in FIGS. 6 and 7, the guide member 80 has a first end portion 81 and a second end portion 82 as opposite end portions. The first end portion 81 is supported by the second rotation shaft 76 of the second rollers 71 such that the guide member 80 is pivotable. It is noted that the first end portion 81 is one end portion of the guide member 80, and the second end portion 82 is the other end portion of the guide member 80. The guide member 80 extends from the second rollers 71 toward the curved guide member 16.

The linking member 90 has a third end portion 91 and a fourth end portion 92 as opposite end portions. The third end portion 91 is coupled to the second end portion 82 of the guide member 80 such that the linking member 90 is swingable. The fourth end portion 92 is coupled to the curved guide member 16 such that the linking member 90 is swingable. Specifically, the guide member 80 has a first support shaft 82*a* at the second end portion 82, the third end portion 91 of the linking member 90 is supported by the first support shaft 82*a* such that the linking member 90 is swingable. The curved guide member 16 has a second support shaft 16*d*. The fourth end portion 92 of the linking member 90 is supported by the second support shaft 16*d* such that the linking member 90 is swingable.

It is noted that a first support shaft may be formed at the third end portion 91 of the linking member 90 to support the second end portion 82 of the guide member 80 such that the guide member 80 is swingable. A second support shaft may be formed at the fourth end portion 92 of the linking member 90 to support the curved guide member 16 swingably.

As illustrated in FIGS. 4 and 6, in the state in which the cover 21 is located at the closed position, and the curved guide member 16 is located at the near position, the guide member 80 and the linking member 90 are folded by swinging of the linking member 90 with respect to the guide member 80 about the first support shaft 82*a* in a direction in which the first end portion 81 of the guide member 80 and the fourth end portion 92 of the linking member 90 are brought closer to each other. In this state, the guide member 80 extends from the second rotation shaft 76 of the second rollers 71 toward the curved portion 16*b* of the curved guide member 16.

The swing angle θ1 of the linking member 90 with respect to the guide member 80 is the smallest. Here, the swing angle θ1 of the linking member 90 with respect to the guide member 80 is an angle between (i) a straight line connecting between the center of the second rotation shaft 76 and the center of the first support shaft 82*a* and a straight line connecting between the center of the first support shaft 82*a* and the center of the second support shaft 16*d*.

The guide member 80 has a first surface 85 at a portion of the guide member 80 which is located near the first end portion 81. The first surface 85 is opposed to a tangent T that is a tangent to the second rollers 71 at contact portions N of the second rollers 71 which are in contact with the first roller 70. In other words, the contact portions N are a position at which the sheet S is nipped between the first roller 70 and the second rollers 71. The first surface 85 is located on a side of the tangent T on which the second rollers 71 is located. In other words, the first surface 85 is located farther from the first roller 70 than the tangent T. The guide member 80 has a second surface 86 that is nearer to the curved portion 16*b* than the first surface 85. In other words, the second surface 86 is located downstream of the first surface 85 in the sheet conveying direction. The second surface 86 extends from the first surface 85 toward the curved portion 16*b* along the tangent T.

When the curved guide member 16 is located at the near position, the first surface 85 and the second surface 86 of the guide member 80 are located above the curved portion 16*b* of the curved guide member 16. Specifically, the first surface 85 and the second surface 86 of the guide member 80 are located nearer to the conveyance path L1 than the curved portion 16*b* of the curved guide member 16. As a result, the sheet S being conveyed downstream in the sheet conveying direction by the intermediate output rollers 77 is conveyed by the first surface 85 and the second surface 86 of the guide member 80 and then guided to the curved portion 16*b*. The sheet S guided to the curved portion 16*b* by the guide member 80 is conveyed by the curved portion 16*b* while being forcibly curved and is discharged onto the output tray 73 formed on the upper surface of the housing 2. Thus, when the curved guide member 16 is located at the near position, the image forming apparatus 1 performs face-down discharging of the sheet S.

When the curved guide member 16 is located at the near position, the sheet S conveyed from the intermediate output rollers 77 is conveyed to the curved guide member 16 after being guided by the guide member 80 extending from the second rollers 71 toward the curved guide member 16. Thus, when compared with the case where the sheet S is conveyed from the intermediate output rollers 77 directly to the curved guide member 16, it is difficult for a step to be formed, resulting in reduction in collision sound caused when the sheet S is conveyed.

In this case, the first surface 85 of the guide member 80 which is adjacent to the second rollers 71 is located on the side of the tangent T on which the second rollers 71 are located. This configuration enables stable conveyance of the sheet S without the sheet S being pressed and waved by the first surface 85 of the guide member 80 when the sheet S being conveyed by the intermediate output rollers 77 starts to be guided by the guide member 80.

The second surface 86 of the guide member 80 extends from the first surface 85 toward the curved portion 16*b* along the tangent T and guides the sheet S conveyed by the intermediate output rollers 77. This configuration makes it possible to convey the sheet S straight from the intermediate output rollers 77 in the direction of the tangent T, thereby preventing bending of the sheet S. This reduces energy generated by bending of the sheet S, thereby reducing collision sound generated when this energy is released.

The first end portion 81 of the guide member 80 is supported by the second rotation shaft 76 of the second rollers 71. This configuration increases the positional accuracy of the guide member 80 with respect to the second rollers 71, making it possible to further reduce the collision sound when the sheet S is guided by the guide member 80.

As illustrated in FIG. 6, the linking member 90 has a third surface 95 that is parallel and flush with the second surface 86 of the guide member 80 when the curved guide member 16 is located at the near position. The third surface 95 of the linking member 90 is located adjacent to the second surface 86 of the guide member 80 in the right and left direction. The sheet S being conveyed downstream in the sheet conveying direction by the intermediate output rollers 77 is guided to the curved portion 16*b* by the third surface 95 of the linking member 90 and the second surface 86 of the guide member 80.

Thus, the sheet S being conveyed by the intermediate output rollers 77 is guided by not only the second surface 86 of the guide member 80 but also the third surface 95 of the linking member 90, thereby reducing bending of the sheet S. This reduces the energy generated by bending of the sheet S, thereby reducing the collision sound generated when the energy is released.

When the cover 21 pivots toward the open position in the state in which the cover 21 is located at the closed position, and the curved guide member 16 is located at the near position, the engagement protrusion 16*c* of the curved guide member 16 is pressed rearward by the first guide-hole definer 23 of the cover 21, causing the curved guide member 16 to pivot from the near position toward the far position. When the curved guide member 16 pivots toward the far position, the fourth end portion 92 of the linking member 90 is moved rearward. When the fourth end portion 92 of the linking member 90 is moved rearward and separated from the first end portion 81 of the guide member 80, the linking member 90 is gradually opened with respect to the guide member 80, which increases the swing angle θ1 between the linking member 90 and the guide member 80. In this case, the engagement protrusion 16*c* of the curved guide member 16 slides downward in the first guide-hole definer 23 of the cover 21.

As illustrated in FIGS. 5 and 7, when the cover 21 has further pivoted and reached the open position, the curved guide member 16 is moved to the far position. In the state in which the cover 21 is located at the open position, and the curved guide member 16 is located at the far position, the linking member 90 has been swung with respect to the guide member 80 about the first support shaft 82*a* in a direction in which the first end portion 81 of the guide member 80 and the fourth end portion 92 of the linking member 90 are moved away from each other, so that the guide member 80 and the linking member 90 are straightened. In this state, the guide member 80 extends from the second rotation shaft 76 of the second rollers 71 toward the curved portion 16*b* of the curved guide member 16, and the linking member 90 extends from the second end portion 82 of the guide member 80 toward the curved portion 16*b* of the curved guide member 16. The swing angle θ1 of the linking member 90 with respect to the guide member 80 is the largest in this state.

The second end portion 82 of the guide member 80 is coupled to the curved guide member 16 by the linking member 90. When the curved guide member 16 is located at the far position, the second end portion 82 of the guide member 80 and the curved portion 16*b* of the curved guide member 16 are spaced apart from each other. When the curved guide member 16 is located at the near position, the second end portion 82 of the guide member 80 and the curved portion 16*b* of the curved guide member 16 are closer to each other than when the curved guide member 16 is located at the far position. Thus, the second end portion 82 of the guide member 80 is coupled to the curved guide member 16 so as to be movable with respect to the curved guide member 16.

In the discharger 7, when the cover 21 is located at the open position, and the curved guide member 16 is located at the far position, the opening 20 is open, and a portion of the conveyance path L1 which is partly defined by the curved portion 16*b* of the curved guide member 16 at a position located downstream of the intermediate output rollers 77 in the sheet conveying direction is open.

In this state, the sheet S being conveyed by the intermediate output rollers 77 is conveyed rearward and discharged to the outside of the housing 2 through the opening 20. The sheet S discharged to the outside of the housing 2 is supported by the curved guide member 16 and the cover 21 being in an inclined posture. Thus, when the curved guide member 16 is located at the far position, the image forming apparatus 1 performs face-up discharging of the sheet S.

In this case, the guide member 80 and the linking member 90 are in the straightened state between the second rollers 71 and the curved guide member 16. Thus, a trailing end portion, in the sheet conveying direction, of the sheet S discharged to the outside of the housing 2 is supported on the guide member 80 and the linking member 90.

That is, when the curved guide member 16 is moved from the near position to the far position, the position of the second end portion 82 in the guide member 80 with respect to the curved guide member 16 is moved, so that the guide member 80 is disposed at a space between the second rollers 71 and the curved guide member 16 to support the sheet S conveyed from the intermediate output rollers 77.

Thus, when the curved guide member 16 is located at the far position, the sheet S conveyed from the intermediate output rollers 77 is supported by the guide member 80, thereby preventing the sheet S from falling into the space between the intermediate output rollers 77 and the curved guide member 16. This improves the ability to load the sheets S discharged to a rear side of the housing 2.

In particular, if the guide member 80 is not disposed in the case where the sheet S having a large size and low resilience is supported by the cover 21 and the curved guide member 16, the sheet S easily falls into the space between the intermediate output rollers 77 and the curved guide member 16. Thus, providing the guide member 80 particularly improves the ability to load the sheets S.

In the case where the sheet S having high resilience such as a postcard paper is supported by the cover 21 and the curved guide member 16, it is difficult for the sheet S to fall into the space between the intermediate output rollers 77 and the curved guide member 16. Thus, in the case where the sheet S does not fall into the space between the intermediate output rollers 77 and the curved guide member 16, the ability to load the sheets S is not deteriorated even when the sheet S is not supported by the guide member 80. Thus, the guide member 80 is capable of supporting the sheet S supported by the cover 21 and the curved guide member 16 when the curved guide member 16 is located at the far position.

The linking member 90 has a fourth surface 96 that supports the sheet S conveyed from the intermediate output rollers 77, when the curved guide member 16 is located at the far position. The fourth surface 96 is continuous to the second surface 86 of the guide member 80 in a direction directed from the second rollers 71 toward the curved guide member 16. The fourth surface 96 is curved so as to protrude upward, for example.

The fourth surface 96 of the linking member 90 is disposed above a straight line connecting between (i) the first support shaft 82*a* about which the third end portion 91 of the linking member 90 is swung and (ii) the second support shaft 16*d* about which the fourth end portion 92 of the linking member 90 is swung. The third surface 95 of the linking member 90 is disposed below the straight line connecting between the first support shaft 82*a* and the second support shaft 16*d*. That is, the fourth surface 96 and the third surface 95 of the linking member 90 are located respectively on opposite sides of the straight line connecting between the first support shaft 82*a* and the second support shaft 16*d*.

Thus, in the linking member 90, the third surface 95 that guides the sheet S when the curved guide member 16 is located at the near position and the fourth surface 96 that supports the sheet S when the curved guide member 16 is located at the far position are located respectively on opposite sides of the straight line connecting between the first support shaft 82*a* and the second support shaft 16*d*. With this configuration, the third surface 95 and the fourth surface 96 are different surfaces, and accordingly each of the third surface 95 and the fourth surface 96 can be fainted in an appropriate shape independently.

The coupling member 8 includes the guide member 80 and the linking member 90 coupled to the guide member 80. When the curved guide member 16 is located at the near position, the guide member 80 and the linking member 90 are folded. When the curved guide member 16 is located at the far position, the guide member 80 and the linking member 90 are straightened.

With this configuration, the distance between the second rollers 71 and the curved guide member 16 when the curved guide member 16 is located at the far position is large when compared with a case where the coupling member 8 includes only the guide member 80, for example. Accordingly, even in the case where the sheet S is of a large size, it is possible to improve the ability of the cover 21 and the curved guide member 16 to load the sheets S discharged to a rear side of the housing 2.

As illustrated in FIG. 7, when the curved guide member 16 is located at the far position, the second surface 86 is inclined so as to be lower at its rear portion (its downstream portion in the sheet conveying direction) than at its front portion (its upstream portion in the sheet conveying direction). Specifically, the second surface 86 is inclined rearward and downward by the angle θ2 with respect to the horizontal direction in the state in which the curved guide member 16 is located at the far position.

Thus, since the second surface 86 is inclined so as to be lower at its rear portion than at its front portion, a force in a direction away from the second rollers 71 acts on the sheet S supported by the second surface 86 of the guide member 80, making it possible to improve the ability of the cover 21 and the curved guide member 16 to load the sheets S.

The fourth surface 96 of the linking member 90 has a curved end portion 96*a* at the third end portion 91. The curved end portion 96*a* is curved downward to a position at which the curved end portion 96*a* does not protrude from the second surface 86 of the guide member 80. That is, the curved end portion 96*a* is curved to a position nearer to the first support shaft 82*a* than the second surface 86 of the guide member 80.

Thus, the fourth surface 96 of the linking member 90 has the curved end portion 96*a* at the third end portion 91, and the curved end portion 96*a* is curved downward to the position at which the curved end portion 96*a* does not protrude from the second surface 86. With this configuration, when the sheet S conveyed from the intermediate output rollers 77 has reached the third end portion 91 of the linking member 90, the sheet S is not caught by the linking member 90. This improves the ability of the cover 21 and the curved guide member 16 to load the sheets S.

When the curved guide member 16 is located at the far position, the guide member 80 and the linking member 90 are straightened, and the swing angle θ1 of the linking member 90 with respect to the guide member 80 is the largest. When the curved guide member 16 is located at the far position, the swing angle θ1 of the linking member 90 with respect to the guide member 80 is set to a value less than 180 degrees. The swing angle θ1 when the curved guide member 16 is located at the far position may be set by adjusting the lengths of the linking member 90 and the guide member 80, for example.

Thus, the swing angle θ1 of the linking member 90 with respect to the guide member 80 when the curved guide member 16 is located at the far position is set to be less than 180 degrees. When the curved guide member 16 is moved from the far position to the near position, the linking member 90 can be smoothly swung with respect to the guide member 80 to fold the linking member 90 and the guide member 80 without tangling of the linking member 90 and the guide member 80.

When the cover 21 pivots toward the closed position in the state in which the cover 21 is located at the open position, and the curved guide member 16 is located at the far position, the engagement protrusion 16*c* of the curved guide member 16 is pressed frontward by the first guide-hole definer 23 of the cover 21, causing the curved guide member 16 to pivot from the far position toward the near position. When the curved guide member 16 pivots toward the near position, the fourth end portion 92 of the linking member 90 is moved frontward.

When the fourth end portion 92 of the linking member 90 is moved frontward toward the first end portion 81 of the guide member 80, the linking member 90 is gradually closed with respect to the guide member 80, which reduces the swing angle θ1 between the linking member 90 and the guide member 80. In this case, the first support shaft 82*a* is moved upward. The engagement protrusion 16*c* of the curved guide member 16 slides upward in the first guide-hole definer 23 of the cover 21. When the cover 21 has further pivoted and reached the closed position, the curved guide member 16 is moved to the near position.

Second Embodiment

While the above-described coupling member 8 includes the guide member 80 and the linking member 90, a coupling member may include only the guide member. For example, a coupling member 108 illustrated in FIGS. 8 and 9 includes a guide member 180 (as another example of the guide member). The guide member 180 includes a first end portion 181 and a second end portion 182 as opposite end portions. The first end portion 181 is supported by the second rotation shaft 76 of the second rollers 71 such that the guide member 180 is pivotable. The second end portion 182 of the guide member 180 has a protruding portion 183 protruding in the right and left direction. The guide member 180 extends from the second rollers 71 toward a curved guide member 116.

The guide member 180 has a first surface 185 and a second surface 186. The first surface 185 is located on a side of the tangent T on which the second rollers 71 is located. The second surface 186 is located downstream of the first surface 185 in the sheet conveying direction. The second surface 186 extends from the first surface 185 toward a curved portion 116*b* along the tangent T.

Figure 8:
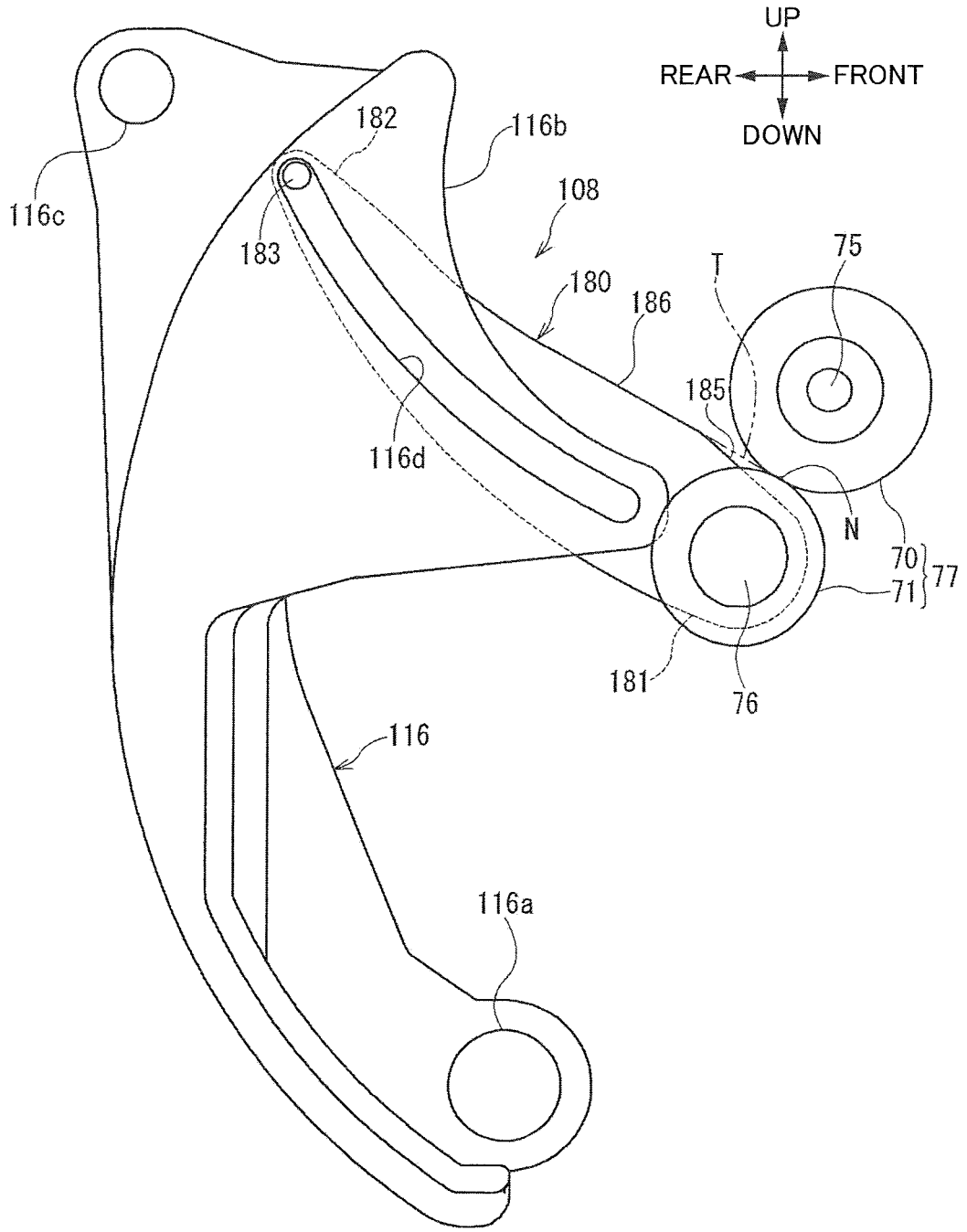
FIG. 8 is an enlarged side elevational view in cross section, illustrating a state in which the curved guide member is located at the near position with a coupling member according to the second embodiment.
Figure 9:
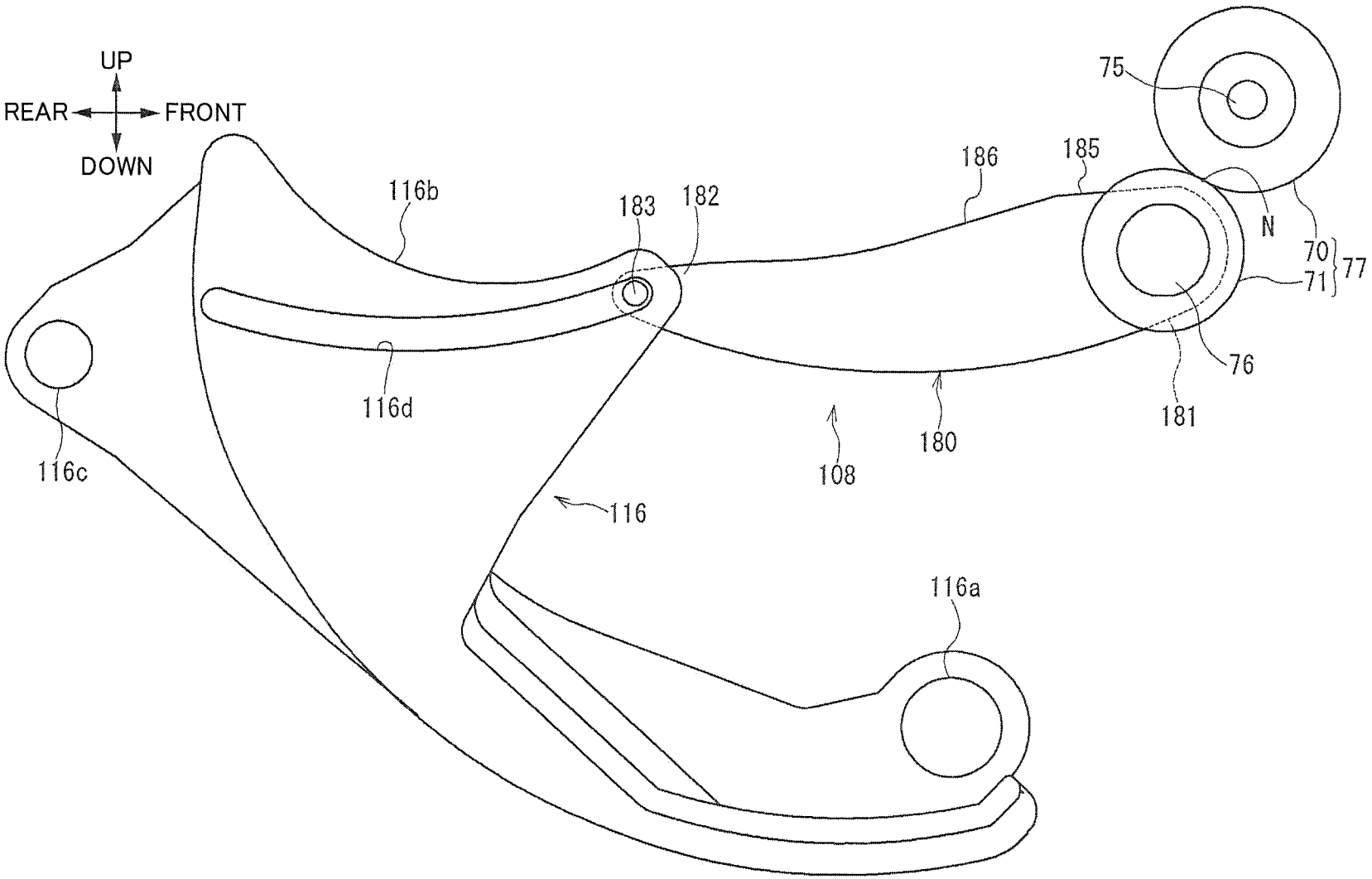
FIG. 9 is an enlarged side elevational view in cross section, illustrating a state in which the curved guide member is located at the far position with the coupling member according to the second embodiment.

The curved guide member 116 illustrated in FIGS. 8 and 9 includes a pivot shaft 116*a*, the curved portion 116*b*, an engagement protrusion 116*c*, and a second guide-hole definer 116*d*. The pivot shaft 116*a*, the curved portion 116*b*, and the engagement protrusion 116*c* respectively have the same configurations of the pivot shaft 16*a*, the curved portion 16*b*, and the engagement protrusion 16*c*. The curved guide member 116 is different from the curved guide member 16 in that the curved guide member 116 does not include the second support shaft 16*d* and includes the second guide-hole definer 116*d*. The other configuration of the curved guide member 116 is the same as that of the curved guide member 16.

The second guide-hole definer 116*d* of the curved guide member 116 defines an elongated hole that is inclined so as to be lower at its front portion than at its rear portion when the curved guide member 116 is located at the near position. The protruding portion 183 formed at the second end portion 182 of the guide member 180 is slidably engaged with the second guide-hole definer 116*d* of the curved guide member 116. When the curved guide member 116 is located at the near position, the protruding portion 183 is located at an upper end portion of the second guide-hole definer 116*d*. When the curved guide member 116 is located at the near position, an end portion of the second guide-hole definer 116*d* which is located on an opposite side from the upper end portion is a lower end portion.

As illustrated in FIG. 8, when the curved guide member 116 is moved to the near position, the first surface 185 and the second surface 186 of the guide member 180 are located above the curved portion 116*b* of the curved guide member 116. Specifically, the first surface 185 and the second surface 186 of the guide member 180 are nearer to the conveyance path L1 than the curved portion 116*b* of the curved guide member 116. The sheet S being conveyed downstream in the sheet conveying direction by the intermediate output rollers 77 is conveyed by the first surface 185 and the second surface 186 of the guide member 180 and then guided to the curved portion 16*b*.

Thus, when the curved guide member 116 is located at the near position, the sheet S conveyed from the intermediate output rollers 77 is guided by the guide member 180 to the curved guide member 116. In the case where the sheet S is conveyed from the intermediate output rollers 77 directly to the curved guide member 116, it is possible to reduce collision sound.

When the cover 21 pivots toward the open position in the state in which the cover 21 is located at the closed position, and the curved guide member 116 is located at the near position, the engagement protrusion 116*c* of the curved guide member 116 is pressed rearward by the first guide-hole definer 23 of the cover 21, causing the curved guide member 116 to pivot from the near position toward the far position. When the curved guide member 116 pivots toward the far position, the protruding portion 183 of the guide member 180 is moved from the upper end portion toward the lower end portion of the second guide-hole definer 116*d*.

As illustrated in FIG. 9, when the cover 21 has further pivoted and reached the open position, the curved guide member 116 is moved to the far position. When the curved guide member 116 is located at the far position, the protruding portion 183 of the guide member 180 is located at the lower end portion of the second guide-hole definer 116*d*. In this state, the guide member 180 extends from the second rotation shaft 76 of the second rollers 71 toward the curved portion 116*b* of the curved guide member 116 and positioned across the space between the second rollers 71 and the curved guide member 16.

When the curved guide member 16 is moved to the far position, an upstream end portion, in the sheet conveying direction, of the sheet S discharged to the outside of the housing 2 is supported by the guide member 180. That is, when the curved guide member 116 is moved from the near position to the far position, the position of the second end portion 182 in the guide member 180 with respect to the curved guide member 116 is moved, so that the guide member 180 is disposed at a space between the second rollers 71 and the curved guide member 116 to support the sheet S conveyed from the intermediate output rollers 77.

Thus, even in the configuration in which the coupling member 108 is constituted only by the guide member 180, when the curved guide member 116 is moved to the near position, the sheet S conveyed from the intermediate output rollers 77 is guided by the guide member 180 to the curved guide member 116, and when the curved guide member 116 is moved to the far position, the sheet S conveyed from the intermediate output rollers 77 is supported by the guide member 180.

When the cover 21 pivots toward the closed position in the state in which the cover 21 is located at the open position, and the curved guide member 116 is located at the far position, the engagement protrusion 116*c* of the curved guide member 116 is pressed frontward by the first guide-hole definer 23 of the cover 21, causing the curved guide member 116 to pivot from the far position toward the near position. When the curved guide member 116 pivots toward the near position, the protruding portion 183 of the guide member 180 is moved from the lower end portion toward the upper end portion of the second guide-hole definer 116*d*. When the cover 21 has further pivoted and reached the closed position, as illustrated in FIG. 8, the curved guide member 116 is moved to the near position.

Effects

In the present embodiment, the image forming apparatus 1 is configured as described above. That is, the image forming apparatus 1 includes the housing 2, the image forming unit 5, the intermediate output rollers 77 constituting the conveyor, the curved guide member 16, and the guide member 80.

The image forming unit 5 is disposed in the housing 2 to form an image on the conveyed sheet S. The intermediate output rollers 77 are disposed in the housing 2 at the positions located downstream of the image forming unit 5 in the sheet conveying direction to convey the sheet S along the conveyance path L1. The curved guide member 16 is disposed downstream of the intermediate output rollers 77 in the sheet conveying direction to guide and curve the sheet S conveyed from the intermediate output rollers 77. The curved guide member 16 is moved between (i) the near position at which the curved guide member 16 is located in the housing 2 and close to the intermediate output rollers 77 and (ii) the far position that is farther from the intermediate output rollers 77 than the near position. The guide member 80 extends from the intermediate output rollers 77 toward the curved guide member 16. When the curved guide member 16 is located at the near position, the guide member 80 guides the sheet S conveyed from the intermediate output rollers 77, to the curved guide member 16.

The first end portion 81 of the guide member 80 is coupled to the intermediate output rollers 77. The second end portion 82 of the guide member 80 is movably coupled to the curved guide member 16. When the curved guide member 16 is located at the far position, the second end portion 82 is moved to the space between the intermediate output rollers 77 and the curved guide member 16 to support the sheet S conveyed from the intermediate output rollers 77.

With this configuration, when the curved guide member 16 is located at the near position, the sheet S conveyed from the intermediate output rollers 77 is conveyed to the curved guide member 16 after being guided by the guide member 80. When compared with the case where the sheet S is conveyed from the intermediate output rollers 77 directly to the curved guide member 16, it is possible to reduce the collision sound. Furthermore, when the curved guide member 16 is located at the far position, the sheet S conveyed from the intermediate output rollers 77 is supported by the guide member 80, thereby preventing the sheet S from falling into the space between the intermediate output rollers 77 and the curved guide member 16. This improves the ability to load the sheets S.

The conveyor includes the first roller 70 and the second rollers 71 disposed on an opposite side of the conveyance path L1 from the first roller 70 and being in contact with the first roller 70. The second rollers 71 include the second rotation shaft 76. The first end portion 81 of the guide member 80 is supported by the second rotation shaft 76 of the second rollers 71 such that the guide member 80 is pivotable. This configuration increases the positional accuracy of the guide member 80 with respect to the second rollers 71, making it possible to further reduce the collision sound when the sheet S is guided by the guide member 80.

The first end portion 81 of the guide member 80 has the first surface 85 located on the side of the tangent T on which the second rollers 71 are located. This configuration enables stable conveyance of the sheet S without the sheet S being pressed and waved by the first surface 85 of the guide member 80 when the sheet S being conveyed by the intermediate output rollers 77 starts to be guided by the guide member 80.

The portion of the guide member 80 which is located downstream of the first surface 85 in the sheet conveying direction has the second surface 86 extending along the tangent T. With this configuration, the sheet S being conveyed by the intermediate output rollers 77 is guided by the second surface 86 to convey the sheet S from the intermediate output rollers 77 in the direction of the tangent T, thereby preventing bending of the sheet S. This reduces the energy generated by bending of the sheet S, thereby reducing the collision sound generated when this energy is released.

When the curved guide member 16 is located at the far position, the second surface 86 is inclined so as to be lower at its downstream portion in the sheet conveying direction than at its upstream portion in the sheet conveying direction. Thus, a force in a direction away from the second rollers 71 acts on the sheet S supported by the second surface 86 of the guide member 80, making it possible to improve the ability of the cover 21 and the curved guide member 16 to load the sheets S.

The guide member 80 includes: the first end portion 81 coupled to the intermediate output rollers 77; and the second end portion 82 located on an opposite side from the first end portion 81. The linking member 90 includes the third end portion 91 and the fourth end portion 92 located on an opposite side from the third end portion 91. The third end portion 91 is swingably coupled to the second end portion 82 of the guide member 80. The fourth end portion 92 is swingably coupled to the curved guide member 16. With this configuration, the distance between the second rollers 71 and the curved guide member 16 when the curved guide member 16 is located at the far position is large when compared with the case where the coupling member 8 includes only the guide member 80, for example. This improves the ability of the cover 21 and the curved guide member 16 to load the sheets S discharged to a rear side of the housing 2.

The linking member 90 has the third surface 95. When the curved guide member 16 is located at the near position, the sheet S conveyed from the intermediate output rollers 77 is guided by the third surface 95. With this configuration, the sheet S being conveyed by the intermediate output rollers 77 is guided by not only the second surface 86 of the guide member 80 but also the third surface 95 of the linking member 90, thereby reducing bending of the sheet S. This reduces the energy generated by bending of the sheet S, thereby reducing the collision sound generated when the energy is released.

The linking member 90 has the fourth surface 96 that supports the sheet S conveyed from the intermediate output rollers 77, when the curved guide member 16 is located at the far position. The fourth surface 96 and the third surface 95 are located respectively on opposite sides of the straight line connecting between the point about which the third end portion 91 is swung and the point about which the fourth end portion 92 is swung. With this configuration, the third surface 95 and the fourth surface 96 are different surfaces, and accordingly each of the third surface 95 and the fourth surface 96 can be formed in an appropriate shape independently.

The fourth surface 96 of the linking member 90 is curved at the third end portion 91 to the position at which the curved end portion 96*a* does not protrude from the second surface 86 of the guide member 80. With this configuration, when the sheet S conveyed from the intermediate output rollers 77 has reached the third end portion 91 of the linking member 90, the sheet S is not caught by the linking member 90. This improves the ability of the cover 21 and the curved guide member 16 to load the sheets S.

When the curved guide member 16 is located at the far position, the swing angle θ1 of the linking member 90 with respect to the guide member 80 is set to a value less than 180 degrees. When the curved guide member 16 is moved from the far position to the near position, the linking member 90 can be smoothly swung with respect to the guide member 80 to fold the linking member 90 and the guide member 80 without tangling of the linking member 90 and the guide member 80.

What is claimed is:

1. An image forming apparatus, comprising:

a housing;

an image forming unit disposed in the housing and configured to form an image on a sheet;

a conveyor disposed in the housing at a position located downstream of the image forming unit in a sheet conveying direction and configured to convey the sheet along a conveyance path;

a curved guide disposed downstream of the conveyor in the sheet conveying direction and configured to move between (i) a near position at which the curved guide is disposed in the housing and guides the sheet conveyed from the conveyor and (ii) a far position that is farther from the conveyor than the near position; and a guide member extending from the conveyor toward the curved guide and configured to guide the sheet conveyed from the conveyor, to the curved guide when the curved guide is located at the near position, the guide member comprising a first end portion coupled to the conveyor, and a second end portion movable with respect to the curved guide, the first end portion and the second end portion being opposite end portions of the guide member, wherein when the curved guide is moved from the near position to the far position, the second end portion of the guide member is moved relative to the curved guide in a direction directed from a downstream end of the curved guide in the sheet conveying direction toward an upstream end of the curved guide in the sheet conveying direction.

2. The image forming apparatus according to claim 1, wherein the conveyor comprises a first roller and a second roller arranged respectively on opposite sides of the conveyance path, and the second roller contacts the first roller, wherein the second roller comprises a rotation shaft, and wherein the first end portion of the guide member is pivotably supported by the rotation shaft of the second roller.

3. The image forming apparatus according to claim 2, wherein the first end portion of the guide member comprises a first surface, and the first surface is located on a second-roller side of a tangent to the second roller at a position at which the second roller contacts the first roller.

4. The image forming apparatus according to claim 3, wherein the guide member comprises a second surface extending along the tangent and located downstream of the first surface in the sheet conveying direction.

5. The image forming apparatus according to claim 4, wherein when the curved guide is located at the far position, the second surface is inclined so as to be lower at a downstream portion of the second surface in the sheet conveying direction than at an upstream portion of the second surface in the sheet conveying direction.

6. The image forming apparatus according to claim 1, wherein the image forming apparatus further comprises a linking member comprising a third end portion and a fourth end portion as opposite end portions of the linking member, and wherein the third end portion is swingably coupled to the second end portion of the guide member, and the fourth end portion is swingably coupled to the curved guide.

7. The image forming apparatus according to claim 6, wherein the linking member comprises a third surface that guides the sheet conveyed from the conveyor, when the curved guide is located at the near position.

8. The image forming apparatus according to claim 7, wherein the linking member comprises a fourth surface that guides the sheet conveyed from the conveyor, when the curved guide is located at the far position, and wherein the fourth surface and the third surface are located respectively on opposite sides of a straight line that connects between a position about which the third end portion is swung and a position about which the fourth end portion is swung.

9. The image forming apparatus according to claim 8, wherein the fourth surface of the linking member is curved at the third end portion of the linking member to a position at which the fourth surface is located below the second surface of the guide member.

10. The image forming apparatus according to claim 6, wherein, when the curved guide is located at the far position, a swing angle of the linking member with respect to the guide member is less than 180 degrees.

* * * * *